US012102186B1

(12) United States Patent
Michaud

(10) Patent No.: US 12,102,186 B1
(45) Date of Patent: Oct. 1, 2024

(54) CUBOID INSERTS FOR IMPROVING BALANCE AND PREVENTING FALLS

(71) Applicant: Newton Biomechanics, LLC, Wayland, MA (US)

(72) Inventor: Thomas C. Michaud, Wayland, MA (US)

(73) Assignee: Newton Biomechanics, LLC, Wayland, MA (US)

( * ) Notice: Subject to any disclaimer, the term of this patent is extended or adjusted under 35 U.S.C. 154(b) by 0 days.

(21) Appl. No.: 18/624,854

(22) Filed: Apr. 2, 2024

Related U.S. Application Data

(60) Provisional application No. 63/493,885, filed on Apr. 3, 2023.

(51) Int. Cl.
*A43B 7/143* (2022.01)
*A43B 7/1455* (2022.01)
(Continued)

(52) U.S. Cl.
CPC ..... *A43B 7/146* (2013.01); *A43B 7/143* (2013.01); *A43B 7/1463* (2022.01); *A43B 7/1464* (2022.01); *A43B 7/149* (2013.01)

(58) Field of Classification Search
CPC ..... A43B 7/142; A43B 7/143; A43B 7/146; A43B 7/149
See application file for complete search history.

(56) References Cited

U.S. PATENT DOCUMENTS 3,589,037 A * 6/1971 Gallagher ..... A43B 17/03 36/4
3,757,774 A * 9/1973 Hatuno ..... A61H 7/001 36/141
(Continued)

FOREIGN PATENT DOCUMENTS

KR 200407457 Y1 * 1/2006
KR 100755029 B1 * 9/2007
(Continued)

OTHER PUBLICATIONS

Araujo, et al. "Successful 10-second one-legged stance performance predicts survival in middle-aged and older individuals." British Journal of Sports Medicine 56.17 (2022): 975-980.
(Continued)

*Primary Examiner* — Megan E Lynch
(74) *Attorney, Agent, or Firm* — Smith Baluch LLP

(57) ABSTRACT

Unique pads, called cuboid lifts, cuboid inserts, or balance-enhancing textured insoles, prevent falls and improve balance by producing site-specific stimulation of different types of cutaneous receptors located along the outer sides of the foot. These cutaneous receptors play a key role in maintaining balance. The outer placement also makes them important in preventing lateral falls, which are far and away the most likely to result in injury. Domes on the upper side of the cuboid inserts increase feedback from the cutaneous receptors as the center of pressure of the person wearing the cuboid inserts moves too far to the outer side of the midfoot. These cuboid inserts are also helpful when managing ankle sprains, as this common injury frequently results in impaired balance.

20 Claims, 7 Drawing Sheets

(51) Int. Cl.

| | |
|---|---|
| ***A43B 7/1463*** | (2022.01) |
| ***A43B 7/1464*** | (2022.01) |
| ***A43B 7/149*** | (2022.01) |

(56) References Cited

U.S. PATENT DOCUMENTS

| | | | | |
|---|---|---|---|---|
| 3,885,555 | A * | 5/1975 | Nobbs | A43B 7/146 601/28 |
| 4,345,387 | A * | 8/1982 | Daswick | A43B 13/14 36/43 |
| 4,694,831 | A * | 9/1987 | Seltzer | A43B 7/146 601/134 |
| 4,733,483 | A * | 3/1988 | Lin | A43B 1/0072 36/28 |
| 4,896,441 | A * | 1/1990 | Galasso | A43B 7/142 36/43 |
| 4,908,962 | A * | 3/1990 | Yung-Mao | A43B 13/184 36/28 |
| 5,664,342 | A * | 9/1997 | Buchsenschuss | A43B 7/146 36/43 |
| 5,685,094 | A * | 11/1997 | Lin | A43B 1/0054 36/43 |
| 5,894,687 | A * | 4/1999 | Lin | A43B 7/146 36/43 |
| 6,237,256 | B1 | 5/2001 | Maki et al. | |
| 6,434,859 | B1 * | 8/2002 | Kim | A43B 7/146 36/43 |
| D474,589 | S | 5/2003 | Dykes | |
| 6,715,221 | B1 * | 4/2004 | Sasaki | A43B 7/06 36/43 |
| 6,910,287 | B2 | 6/2005 | Truelsen | |
| 7,231,730 | B1 | 6/2007 | Ryan et al. | |
| 7,426,794 | B2 | 9/2008 | Swensen | |
| 8,405,510 | B2 | 3/2013 | Shieh et al. | |
| D698,933 | S | 2/2014 | Pan | |
| 10,188,172 | B1 * | 1/2019 | Wurtz | A43B 17/00 |
| 10,847,051 | B2 | 11/2020 | Bennett et al. | |
| 11,642,279 | B2 | 5/2023 | Splichal | |
| D989,449 | S | 6/2023 | Zheng | |
| 2002/0088140 | A1 * | 7/2002 | Wang | A43B 5/08 36/141 |
| 2003/0172553 | A1 | 9/2003 | Truelsen | |
| 2004/0111924 | A1 * | 6/2004 | Riccardi | A43B 7/146 36/141 |
| 2005/0050771 | A1 * | 3/2005 | Dananberg | A43B 7/144 36/43 |
| 2006/0059725 | A1 * | 3/2006 | Lien | A43B 17/00 36/141 |
| 2006/0123663 | A1 | 6/2006 | Swensen | |
| 2007/0271820 | A1 * | 11/2007 | Nurse | A43B 13/38 36/43 |
| 2008/0022561 | A1 * | 1/2008 | Klavano | A43B 7/146 36/141 |
| 2008/0141562 | A1 | 6/2008 | Peveto | |
| 2009/0044424 | A1 | 2/2009 | Kohler et al. | |
| 2009/0056171 | A1 * | 3/2009 | Lin | A43B 17/035 36/29 |
| 2011/0126422 | A1 | 6/2011 | Vattes et al. | |
| 2011/0175736 | A1 | 7/2011 | Shieh et al. | |
| 2012/0073162 | A1 * | 3/2012 | Guirado Martinez | A43B 17/00 36/43 |
| 2014/0059885 | A1 * | 3/2014 | Patchett | A43B 17/03 36/44 |
| 2015/0143714 | A1 * | 5/2015 | Tzeng | A43B 7/143 36/43 |
| 2016/0183627 | A1 * | 6/2016 | Ho | A43B 7/146 36/141 |
| 2017/0340058 | A1 * | 11/2017 | Madore | A43B 7/146 |
| 2018/0103717 | A1 * | 4/2018 | Tsai | A43B 7/144 |
| 2018/0243166 | A1 | 8/2018 | Splichal et al. | |
| 2019/0066532 | A1 | 2/2019 | Bennett et al. | |
| 2019/0116922 | A1 * | 4/2019 | Wurtz | A43B 7/141 |
| 2021/0000686 | A1 | 1/2021 | Splichal | |
| 2022/0110411 | A1 * | 4/2022 | Gusenoff | A43B 17/00 |
| 2022/0133663 | A1 | 5/2022 | Splichal | |
| 2022/0408881 | A1 * | 12/2022 | Chen | A43B 7/143 |
| 2023/0355471 | A1 | 11/2023 | Splichal | |

FOREIGN PATENT DOCUMENTS

| | | | | |
|---|---|---|---|---|
| WO | WO-9932004 | A1 * | 7/1999 | A43B 17/02 |
| WO | WO-2011135278 | A1 * | 11/2011 | A43B 1/0045 |
| WO | WO-2014080217 | A1 * | 5/2014 | A43B 17/03 |

OTHER PUBLICATIONS

Clark, et al. "Enhanced somatosensory feedback reduces prefrontal cortical activity during walking in older adults." Journals of Gerontology Series A: Biomedical Sciences and Medical Sciences 69.11 (2014): 1422-1428.

Collings, et al. "Effects of the site and extent of plantar cutaneous stimulation on dynamic balance and muscle activity while walking." The Foot 25.3 (2015): 159-163, 2 pages.

Fallon, et al. "Evidence for strong synaptic coupling between single tactile afferents from the sole of the foot and motoneurons supplying leg muscles." Journal of Neurophysiology 94.6 (2005): 3795-3804.

Hatton, et al. "Altering gait by way of stimulation of the plantar surface of the foot: the immediate effect of wearing textured insoles in older fallers." Journal of foot and ankle research 5 (2012): 1-6.

Hatton, et al. "The effect of textured surfaces on postural stability and lower limb muscle activity." Journal of Electromyography and Kinesiology 19.5 (2009): 957-964.

Hayes, et al. "Etiology and prevention of age-related hip fractures." Bone 18.1 (1996): S77-S86, 10 pages.

Huang, et al. "The effect of support surface and footwear condition on postural sway and lower limb muscle action of the older women." PLoS One 15.6 (2020): e0234140, 11 pages.

Johnson, "The roles and functions of cutaneous mechanoreceptors." Current opinion in neurobiology 11.4 (2001): 455-461, 34 pages.

Lirani-Silva, et al. "Continuous use of textured insole improve plantar sensation and stride length of people with Parkinson's disease: A pilot study." Gait & posture 58 (2017): 495-497.

Maki, et al. "Age-related differences in laterally directed compensatory stepping behavior." The Journals of Gerontology Series A: Biological Sciences and Medical Sciences 55.5 (2000): M270-M277.

Maki, et al. "Effect of facilitation of sensation from plantar foot-surface boundaries on postural stabilization in young and older adults." Journals of Gerontology Series A: Biomedical Sciences and Medical Sciences 54.6 (1999): M281-M287.

Marco, et al. "Proprioceptive effects on gait and postural stability through mechanical stimulation with an Internal and External Heel Wedge: An interventional single-arm study." Journal of Bodywork and Movement Therapies 24.3 (2020): 195-201.

McKeon, et al. "Altered plantar-receptor stimulation impairs postural control in those with chronic ankle instability." Journal of sport rehabilitation 21.1 (2012): 1-6, 2 pages.

Mickle, et al. "Efficacy of a progressive resistance exercise program to increase toe flexor strength in older people." Clinical Biomechanics 40 (2016): 14-19, 27 pages.

Non-Provisional Design Patent Application Filing for U.S. Appl. No. 29/873,557, filed Apr. 3, 2023.

Palluel, et al. "Do spike insoles enhance postural stability and plantar-surface cutaneous sensitivity in the elderly?." Age 30 (2008): 53-61, 9 pages.

Palluel, et al. "The lasting effects of spike insoles on postural control in the elderly." Behavioral neuroscience 123.5 (2009): 1141-1147.

Petridou, et al. "What works better for community-dwelling older people at risk to fall? A meta-analysis of multifactorial versus physical exercise-alone interventions." Journal of aging and health 21.5 (2009): 713-729, 19 pages.

Robbins, et al. "Foot position awareness: The effect of footwear on instability, excessive impact, and ankle spraining." Critical Reviews™ in Physical and Rehabilitation Medicine 9.1 (1997), 53-74, 22 pages.

(56) References Cited

OTHER PUBLICATIONS

Robbins, et al. "Running-related injury prevention through innate impact-moderating behavior." Med Sci Sports Exerc 21.2 (1989): 130-139.
Song J, et al. Effects of eccentric exercises on foot structure, balance, and dynamic plantar loading. Gait Study Center, Temple University School of Podiatric Medicine. In press 2023, 2 pages.
Strzalkowski, et al. "Cutaneous afferent innervation of the human foot sole: what can we learn from single-unit recordings?." Journal of neurophysiology 120.3 (2018): 1233-1246, 14 pages.
Waddington, et al. "Textured insole effects on ankle movement discrimination while wearing athletic shoes." Physical Therapy in Sport 1.4 (2000): 119-128.
Wilson, et al. "Effect of textured foot orthotics on static and dynamic postural stability in middle-aged females." Gait & posture 27.1 (2008): 36-42.
Yoshida, et al. "Detecting differences in gait initiation between older adult fallers and non-fallers through multivariate functional principal component analysis." Journal of Biomechanics 144 (2022): 111342, 73 pages.
Zehr, et al. "Cutaneous stimulation of discrete regions of the sole during locomotion produces "sensory steering" of the foot." BMC sports science, medicine and rehabilitation 6 (2014): 1-21.

* cited by examiner

CUBOID INSERTS FOR IMPROVING BALANCE AND PREVENTING FALLS

CROSS-REFERENCE TO RELATED APPLICATION(S)

This application claims the priority benefit, under 35 U.S.C. 119 (e), of U.S. Application No. 63/493,885, filed Apr. 3, 2023, and entitled "A Textured Insole," which is incorporated herein by reference in its entirety for all purposes.

BACKGROUND

Like it or not, as we age, most of our sensory systems begin to break down: our hearing worsens, our vision gets blurry, and our reflexes slow down. An underappreciated sensory system that also worsens with age are the cutaneous receptors located along the bottom of our feet: they lose the ability to accurately quantify pressure. This is a big deal because information supplied by these tiny receptors plays a huge role in keeping us upright and balanced, as they supply a rich source of sensory information that allows us to constantly track the location of our balance point (a.k.a. center of pressure (COP)). If the center of pressure veers off too far in one direction, a reflexive muscular response brings us back to a safer balance point.

FIGS. 1A-1C illustrates how your COP moves as you lean forward. When standing on both feet, the COP is located directly between your feet (position A as shown in FIG. 1A). If you (inadvertently) lean too far forward, then your COP will move toward to your toes (position B in FIG. 1A). Cutaneous receptors in the soles of your feet should sense this shift in pressure and reflexively force your toes to push down to help you regain balance as shown in FIG. 1B. You can demonstrate this corrective response on yourself by keeping your arms at your side as you slowly lean forward. As your COP approaches your anterior fall envelope (the farthest distance you can lean safely forward without falling), you should feel your toes push down to reposition your COP (arrows C in FIG. 1B). While walking, your COP follows the path D illustrated in FIG. 1C.

FIG. 2 shows these cutaneous receptors, which include Meissner's corpuscles, Merkel disc receptors, Pacinian corpuscles, and Ruffini's corpuscles, which are also called Ruffini endings. Meissner's corpuscles and Merkel receptors are low-threshold receptors that respond to dynamic skin deformation and especially skin indentation-they are fast adapting and stop firing quickly-while Merkel disc receptors and Ruffini's corpuscles are slow adapting and fire constantly while being stimulated (but have higher thresholds to get them to fire). The cutaneous receptors are unlike other sensory receptors associated with balance in that they interact with a wide range of interneurons, allowing them to favorably modify activity in limbs besides the stimulated limb. This comes in handy for preventing falls, as it allows you to quickly move the opposite limb and/or adjust arm position in order to reestablish balance.

FIG. 3 shows the locations of the different types (from left to right, Meissner's corpuscles, Merkel disc receptors, Pacinian corpuscles, and Ruffini's corpuscles) of cutaneous receptors in the bottom of the foot determined using microneurography. Notice the greater concentration of receptors located along the lateral side of the foot and the toes. There is a gradual increase in sensory receptors when moving from the back of the heel to the forefoot, and when moving from the medial to the lateral side of the foot. The outer side of the midfoot is especially well innervated, possessing both slow and fast adapting cutaneous receptors.

The abundance of sensory receptors along the lateral foot makes sense when considering the progression of the center of mass while walking. Because we spend so much time with our weight distributed over the lateral portion of our foot, it is beneficial for the lateral portion to provide the greatest amount of information in order to allow us to respond immediately to even minor perturbations that may affect balance. The plethora of cutaneous receptors located along the lateral foot also helps in preventing lateral falls, which are the most dangerous type of falls. While forward falls can be prevented by firmly pressing down with your toes, and medial falls are rarely a problem as the opposite leg is there for support, preventing a lateral fall involves a complex cross-over movement from the opposite leg, which is difficult to perform and nearly impossible to recover from once initiated. Seniors who are most likely to fall have greater lateral displacement of their center of mass while initiating their first step while walking. Lateral falls also result in higher fracture rates.

Unfortunately, as we age, the cutaneous receptors in the bottom of our feet become less sensitive. Even without underlying neuropathy, it takes 20% more pressure to stimulate cutaneous receptors in the soles of the feet by age 50, and 75% more pressure to stimulate the same receptors by age 80. The reduced sensory input from the soles of our feet makes it extremely difficult to maintain balance and adds to the high fall rate present in senior citizens. In any given year, nearly 40% of seniors aged 70 and over will fall at least once, and the resultant injuries often begin a downward spiral of weakness and frailty.

SUMMARY

For more than 50 years, researchers have attempted to improve balance and prevent falls by incorporating textured insoles with specific elevations designed to stimulate cutaneous receptors. These textures range from small triangles and pyramids to round tubes and/or circular nodules. Some are made from hard plastics, and others from soft foams. In theory, textured insoles improve balance by increasing output from cutaneous receptors that are becoming increasingly insensitive with age. Unfortunately, these textured insoles have never provided impressive efficacy. Some research shows these insoles reduce fall risk, while other studies show these insoles produce little change, or worse, they can impair balance making you more vulnerable to a fall.

One problem with textured insoles is that the irritating textures are applied uniformly over the entire foot. This can have negative consequences as the muscular response to pressure along the bottom of the foot varies depending upon the location of the stimuli. For example, stimulating the skin under the inner forefoot produces a reflex downward contraction of the toe muscles, which distributes force away from the metatarsal heads into the toes. In contrast, stimulating the skin beneath the arch has the opposite effect in that it causes the toes to move upward, shifting pressure away from the toes and onto the metatarsal heads. The inability of the toes to push downward greatly increases the risk of falling forward.

The inventive textured insoles exploit the dynamic response of Meissner's corpuscles and Merkel receptors at the lateral edge of the midfoot to prevent falls. These balance-enhancing textured insoles, also known as cuboid inserts or cuboid lifts because they are worn beneath the cuboid, have domes or protrusions, also called balance buttons, that deform and indent skin along the lateral edge of the midfoot when the person wearing them leans too far to the side. This deformation or indentation triggers a reflexive muscular response that prevents a lateral fall. In addition, the balances buttons on the cuboid inserts promote a wider, more stable gait, reducing the likelihood of leaning too far to the left or right.

An inventive cuboid lift may include an elastomeric pad having a first side and a second side opposite the first side and sized to fit on an insole of a shoe or footbed of a sandal. There are first domes disposed along a lateral edge of the first side of the elastomeric pad and second domes disposed on the first side of the elastomeric pad medial to the first domes. The first domes have a first height and the second domes have a second height smaller than the first height.

The elastomeric pad can be sized and shaped to fold at a lateral edge of the insole such that respective portions of the first domes are positioned to apply pressure to a lateral side of a foot of a person wearing the shoe or sandal in response to excessive lateral displacement of a center of pressure of the person wearing the shoe or sandal. The elastomeric pad can have a thickness of about 2 mm to about 4 mm. The elastomeric pad, first domes, and second domes can be formed from a single piece of elastomeric material. Suitable elastomeric materials include polyurethane and ethylene vinyl acetate. The elastomeric material has a Shore A hardness of about 40 to about 60 (e.g., about 45, 50, or 55).

Adjacent ones of the second domes may be spaced apart from each other by about 12 mm to about 16 mm.

The cuboid lift can also include third domes disposed on the first side of the elastomeric pad between the first domes and the second domes. The third domes may have a third height greater than the second height and smaller than the first height. The first height can be about 4 mm to about 5 mm, the second height can be about 2 mm to about 3 mm, and the third height can be about 3 mm to about 4 mm. The first domes ca have diameters of about 9 mm to about 12 mm, the second domes can have diameters of about 5 mm to about 7 mm, and the third domes can have diameters of about 7 mm to about 9 mm.

The cuboid lift can also include a pressure-sensitive adhesive, disposed on the second side of the elastomeric pad, to adhere the cuboid lift to the insole of the shoe or footbed of the sandal.

Another inventive cuboid lift includes an elastomeric pad, having a first side and a second side opposite the first side, to fit on an insole of a shoe or footbed of a sandal. It also includes first domes, disposed along a lateral edge of the first side of the elastomeric pad, to stimulate a lateral side of a midfoot of a person wearing the shoe or sandal. And it includes second domes, disposed on the first side of the elastomeric pad medial to the first domes, to stimulate a lateral aspect of a plantar portion of the midfoot of the person wearing the shoe or sandal. It may also include a pressure-sensitive adhesive, disposed on the second side of the elastomeric pad, to adhere the elastomeric pad to the insole of the shoe or footbed of the sandal.

An inventive balance-enhancing textured insert for an insole of a shoe or footbed of a sandal comprises a base and curved nodules extending from an upper surface of the base. The base has two curved edges joined at two apex corners. The curved nodules are configured to stimulate cutaneous receptors on a sole and a lateral side of a foot of a person wearing the shoe or sandal so as to prompt a reflexive muscle response to a lateral shift in a center of pressure of the person. This reflexive muscle response prevents the person from falling. The curved nodules can be arranged in arcuate rows on the upper surface of the base and.can progressively increase in height from a medial side of the base to a lateral side of the base.

All combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are part of the inventive subject matter disclosed herein. The terminology used herein that also may appear in any disclosure incorporated by reference should be accorded a meaning most consistent with the particular concepts disclosed herein.

BRIEF DESCRIPTIONS OF THE DRAWINGS

The skilled artisan will understand that the drawings primarily are for illustrative purposes and are not intended to limit the scope of the inventive subject matter described herein. The drawings are not necessarily to scale; in some instances, various aspects of the inventive subject matter disclosed herein may be shown exaggerated or enlarged in the drawings to facilitate an understanding of different features. In the drawings, like reference characters generally refer to like features (e.g., functionally similar and/or structurally similar elements).

DETAILED DESCRIPTION

Figures 4A, 4B, 4C:
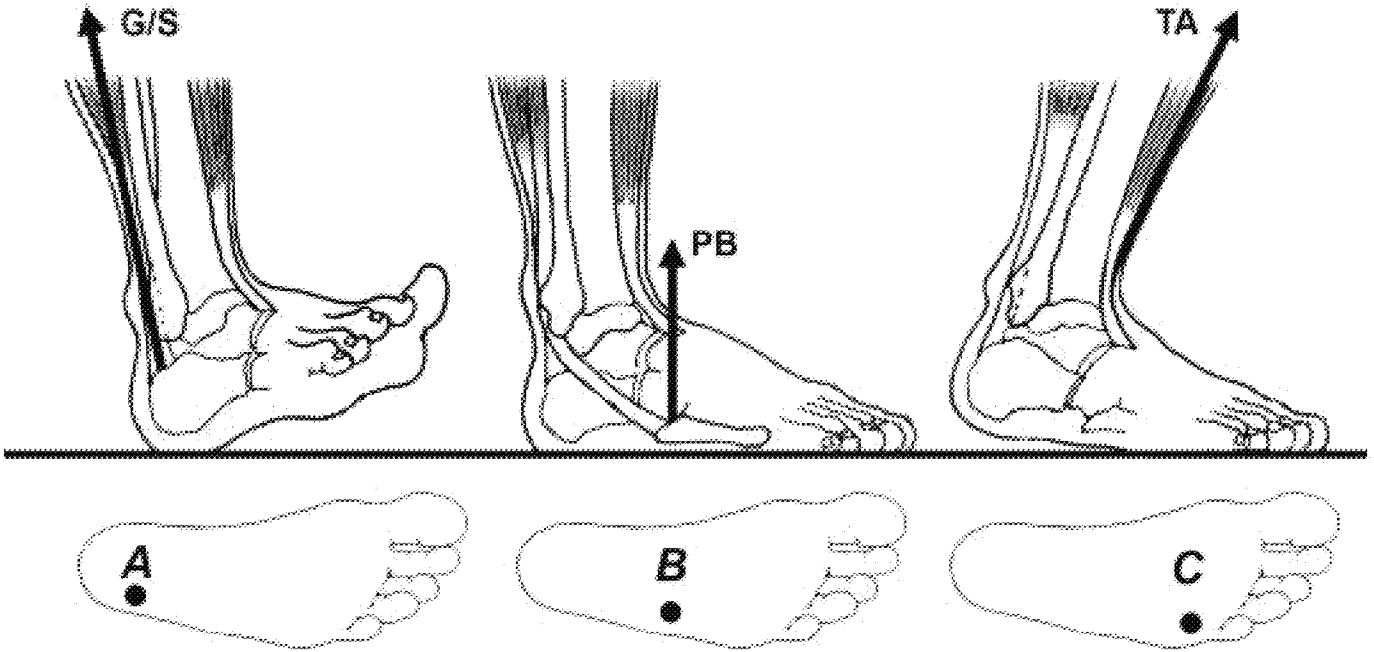
FIG. 4A shows that stimulating cutaneous receptors in the heel increases activity in the gastroc/soleus muscles (G/S).
FIG. 4B shows that stimulating the lateral midfoot increases activity in peroneus brevis (PB).
FIG. 4C shows that stimulating the forefoot increases activity in tibialis anterior (TA).

FIGS. 4A-4C illustrate site-specific muscular response to cutaneous stimulation of the sole of the foot of a person walking forward-behavior that can be exploited for fall prevention. A study using advanced EMG technologies to stimulate specific cutaneous receptors in different locations along the bottom of the foot shows that when cutaneous receptors beneath the heel are stimulated, there is an immediate increase in activity of the gastroc and soleus (G/S) muscles (FIG. 4A), with inhibition of tibialis anterior. Stimulating the lateral midfoot increases activity in peroneus brevis (PB; FIG. 4B), while stimulating the lateral forefoot (FIG. 4C) increases activity in tibialis anterior (TA). Stimulating the peroneal muscles is extremely useful for fall prevention because it can prevent lateral displacement of the center of mass while balancing over one foot.

Figure 1A:
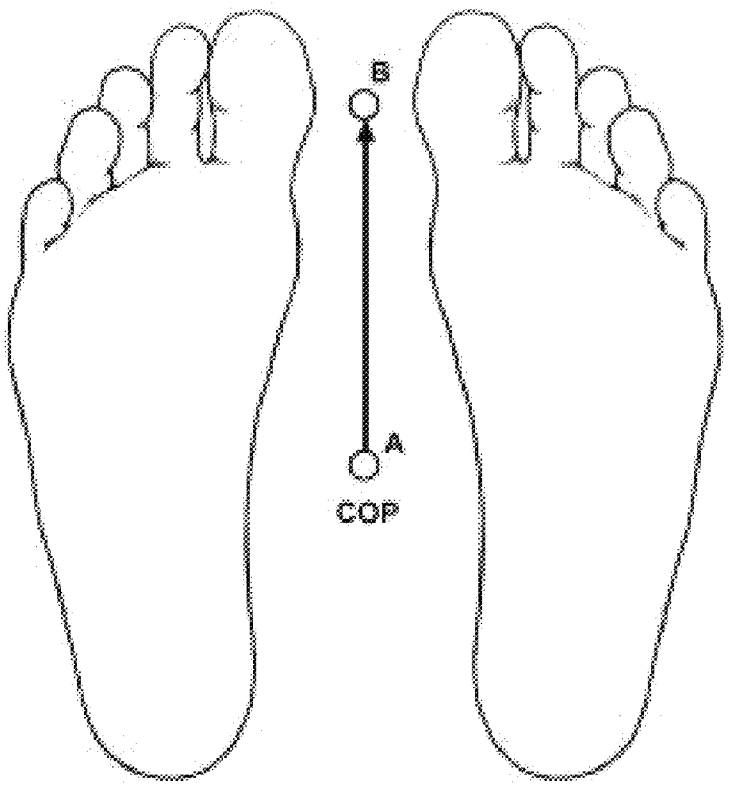
FIG. 1A shows the center of pressure (COP) of a person standing still.
Figure 1B:
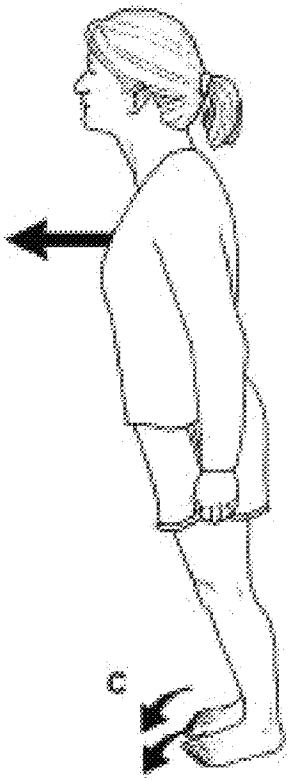
FIG. 1B illustrates how a person's COP moves as the person leans forward.
Figure 1C:
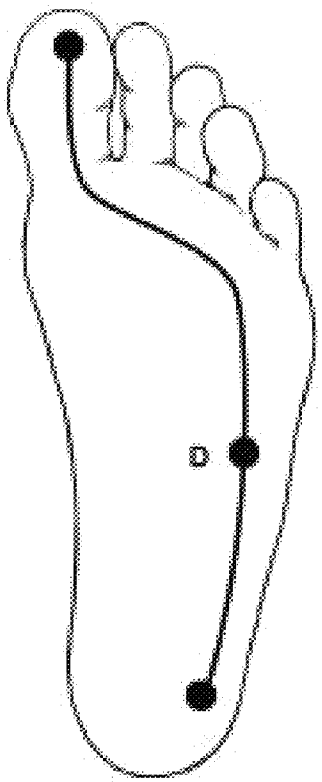
FIG. 1C illustrates movement of a person's COP moves as the person walk.
Figure 2:
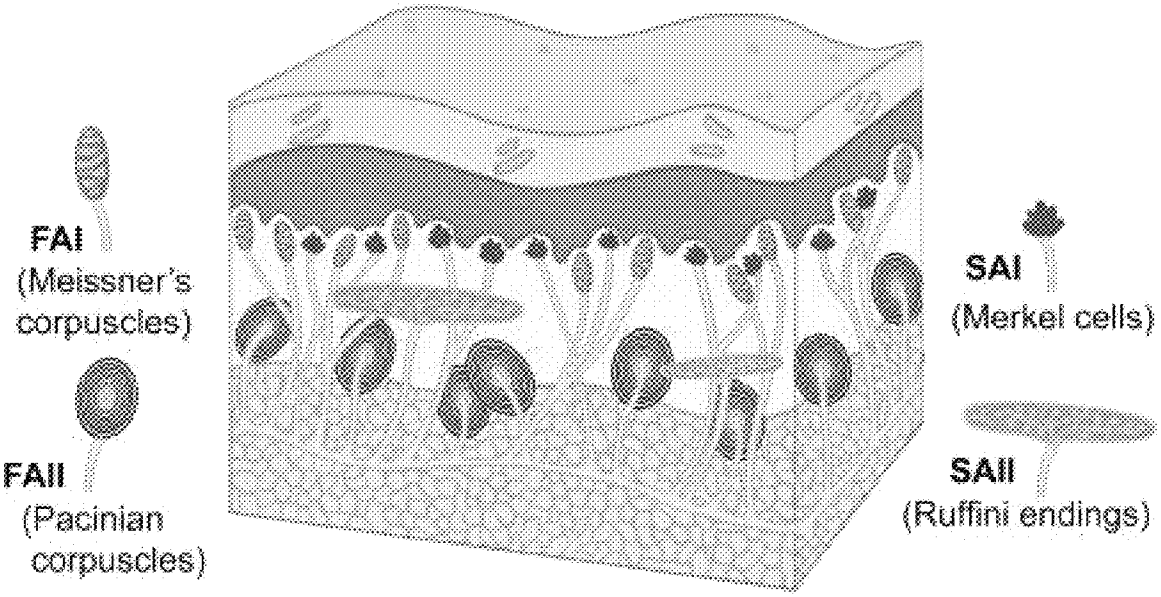
FIG. 2 illustrates cutaneous receptors in a section of the sole of a person's foot.
Figure 3:
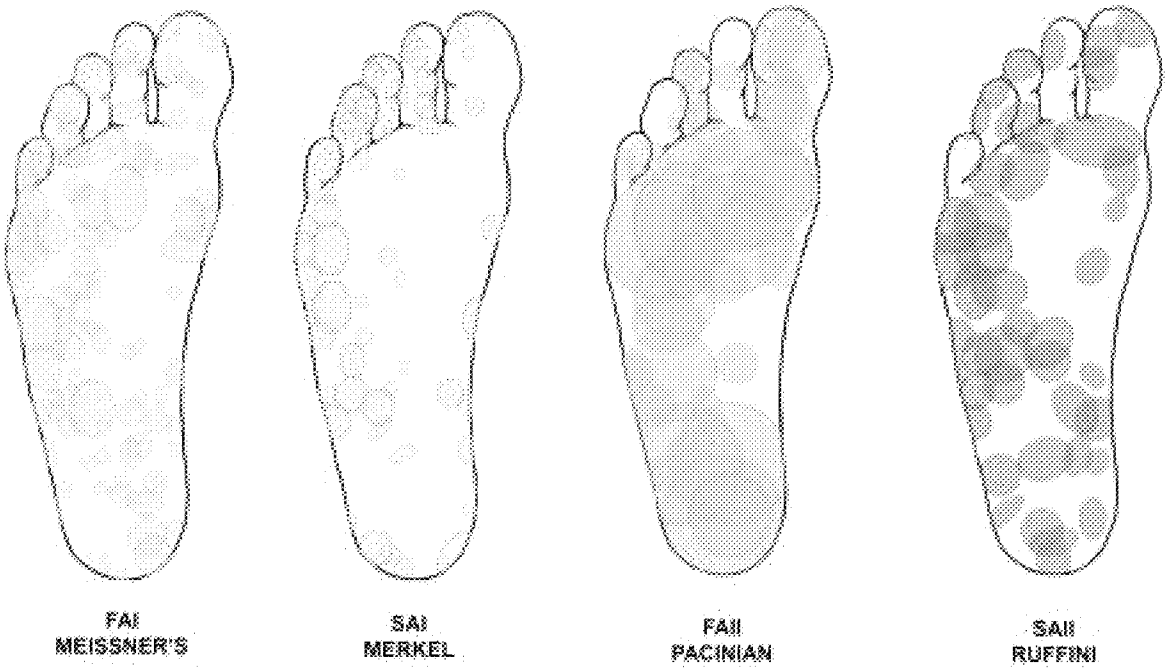
FIG. 3 shows locations of different types of cutaneous receptor along the sole of a person's foot.

More generally, FIGS. 4A-4C show bones and muscles of a foot and a lower leg in different stages of movement. The foot includes a heel part, a midfoot part, a ball part, a toe part, and a sole. The sole of the foot has many cutaneous receptors as described above with respect to FIGS. 2 and 3. The foot also includes a lateral (outer) portion and a medial (inner) portion. The midfoot part includes an arch with the arch more pronounced on the medial portion of the midfoot part. The lateral portion of the sole of the foot includes a large number of the cutaneous receptors. While walking and running, the lateral portion of the heel part of the sole of the foot is generally the first part of the foot to strike a surface. The foot then pivots on the heel bringing forward and down the other parts of the foot.

As shown in FIGS. 4A-4C, the center of pressure on the sole of the foot changes with different stages of movement. The center of pressure with the greatest amount of pressure is position B (FIG. 4B) when the person's body mass is centered over the foot while walking or running. FIGS. 4A and 4B show centers of pressure A and C representing, respectively, when the foot is first placed down on the surface and when the foot is about to be raised off the surface when walking or running. The changing of the center of pressures as someone moves changes the stimuli that is sent. When a foot is in position A, the cutaneous receptors send stimuli and there is an immediate increase in activity of soleus and gastric muscles G/S in FIG. 4A. When a foot is in position B, the cutaneous receptors send stimuli and there is an immediate increase in activity of peroneal muscles PB in FIG. 4B. When a foot is in position C, the cutaneous receptors send stimuli and there is an immediate increase in activity of tibialis anterior muscles TA in FIG. 4C. Given the large number of cutaneous receptors of the lateral portion of the sole of the foot and the understanding that a person spends most of their time with the person's weight on the lateral portion of the midfoot part of the sole of the foot while in position C, the midfoot lateral portion generally gives the highest amount of stimuli output.

FIGS. 5A-5H show different views of a cuboid insert 100, also called a balance-enhancing textured insole or balance-enhancing insert, designed to stimulate cutaneous receptors along the lateral portion of the midfoot part of the sole for preventing falls. This cuboid insert 100 is intended to be placed on the insole of a shoe or footbed of a sandal. When a person is wearing the shoe or sandal, the cuboid insert extends underneath the cuboid, which is a squat tarsal bone on the outer side of the foot, articulating with the heel bone and the fourth and fifth metatarsals, and around the lateral edge of the foot as described below.

The cuboid insert 100 has a series of rounded elevations 120-122, also called domes, nodules, protrusions, or balance buttons, which get progressively larger when moving laterally across the cuboid insert 100. The domes 122 on the inner (medial) side of the cuboid insert 100 have smaller elevations (heights) to stimulate slow-adapting cutaneous receptors on the lateral aspect of a plantar portion of the midfoot of the person wearing the shoe or sandal. These cutaneous receptors provide constant information regarding the location of the center of mass. The domes 120 on the outer (lateral) side of the cuboid insert 100 have larger elevations stimulate a lateral side of a midfoot of a person wearing the shoe or sandal if that person leans too far laterally. The domes 120 on the outer side are placed far enough laterally that a person wearing a shoe or sandal with the cuboid insert 100 could avoid pressing them by walking with a slightly wider base of gait. Walking with your feet farther apart greatly diminishes the risk of lateral falls as your center of pressure is maintained in a more central position. Should the person wearing the cuboid inserts 100 accidentally shift his or her weight so far to the side that they press on the larger nodules (domes 120), it is likely to initiate an immediate response from the fast-adapting Meissner's corpuscles, which have extensive branches to specific muscles in the lower extremity responsible for fall prevention. Last but not least, the entire cuboid insert 100 acts as a wedge lifting the outer side of the foot, which shifts the center of pressure to a safer midline position.

The cuboid insert 100 comprises an elastomeric base or pad with a top (foot-facing) side 101, a bottom (ground-facing) side 102, and a generally constant thickness (e.g., about 2 mm, 3 mm, 4 mm, or any value from about 2 mm to about 4 mm). The pad pushes the balance buttons (domes 120-122) up with a little more force, improving their efficacy. The domes 120-122 extend from the top side 101 of the cuboid insert 100. The bottom 102 of the cuboid insert 100 is generally flat and may be at least partially coated with a pressure-sensitive adhesive layer 130 that adheres the bottom 102 of the cuboid insert 100 to the insole of a shoe or footbed of a sandal. If desired, the pressure-sensitive adhesive layer 130 can be protected by a removable adhesive backing (not shown) until the cuboid insert 100 is placed on an insole or footbed.

The base has a lateral edge 111 and a medial edge 112. The medial edge 112 has a greater arc than the lateral edge 111. The arc of the medial edge 112 is to allow the cuboid insert 100 to best fit the arch of the foot. The lateral and medial edges 111, 112 intersect at first and second apex corners 113. The lateral and/or medial edges 111, 112 may have chamfers 114 (sloped surfaces, e.g., sloped between 15 to 45 degrees) as shown in FIGS. 5E-5H but could be straight or curved instead.

As shown in FIGS. 5A, 5B, and 5E-5H, the domes 120-122 have different sizes and are arrayed in arcuate rows with a fixed or pre-determined space between each dome. The largest domes 120 are in a lateral curved or arcuate row that runs along the lateral edge 111 of the cuboid insert 100, the smallest domes 122 are in a medial arcuate row that runs along the medial edge 112, and the medium domes 121 are in a middle arcuate row that runs between the other two arcuate rows of domes 120, 122. Each row can have the same number of domes or a different number of domes. In FIGS. 5A, 5B, and 5E-5H, there are six large domes 120 in the lateral arcuate row, four medium domes 121 in the middle arcuate row, and three small domes 122 in the medial arcuate row. Other cuboid inserts may have more or fewer arcuate rows, with more or fewer domes per row and/or total.

The domes 120-122 have sizes and positions selected to increase or maximize the stimulation that the domes 120-122 apply to the cutaneous receptors on the bottom of the foot when the cuboid insert 100 is worn in a shoe or sandal.

Figure 5B:
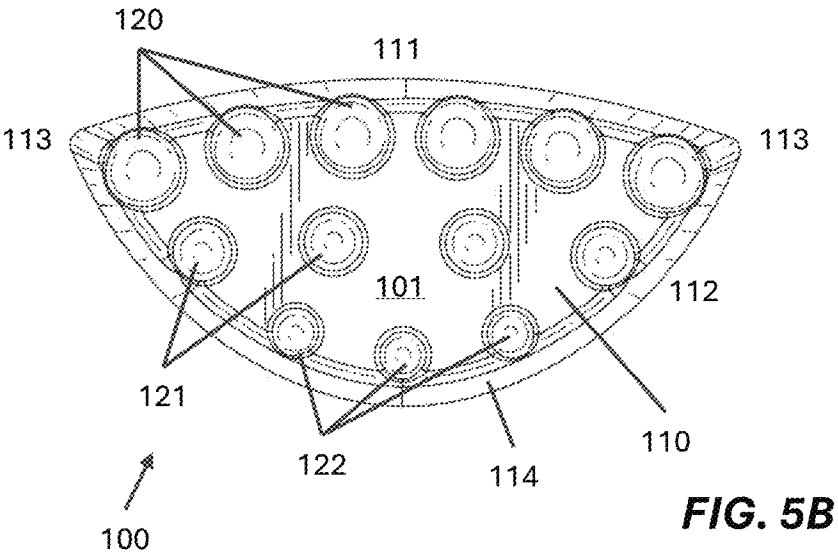
FIG. 5B shows a plan view of the top side of the cuboid insert.
Figure 5A:
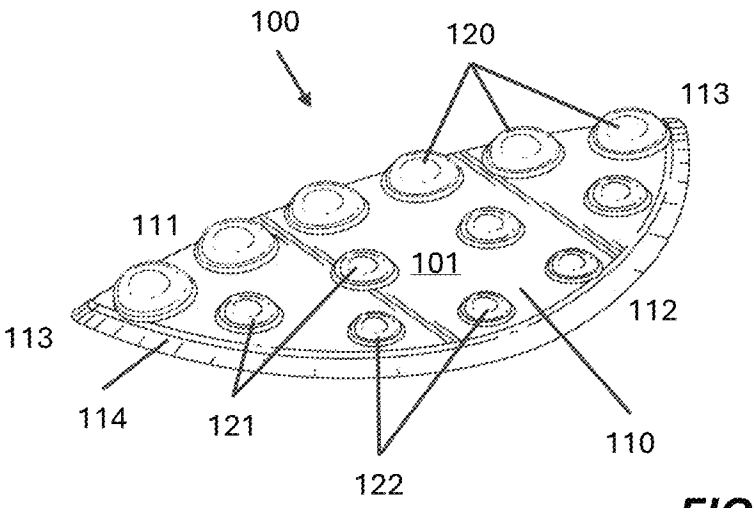
FIG. 5A shows a perspective view of a top side of a cuboid insert, also called a balance-enhancing textured insole or balance-enhancing insert.
Figure 5D:
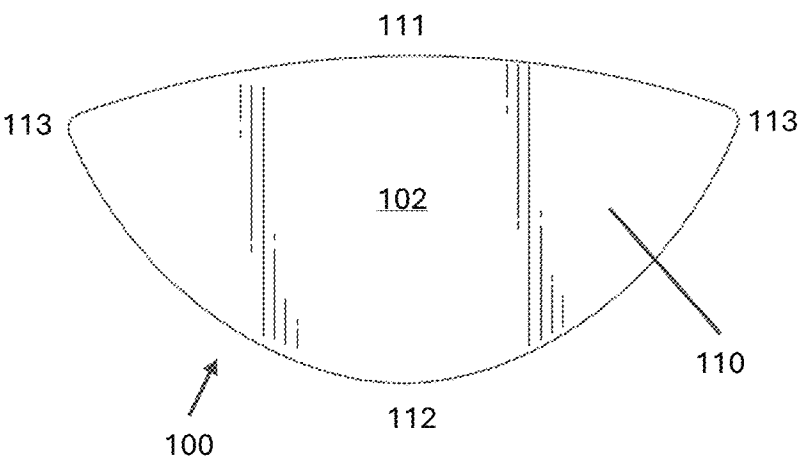
FIG. 5D shows a plan view of the bottom side of the cuboid insert.
Figure 5C:
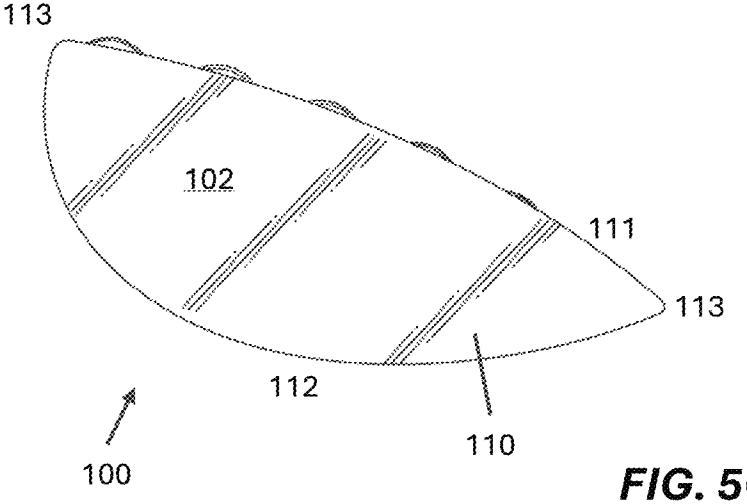
FIG. 5C shows a perspective view of a bottom side of the cuboid insert.
Figure 5F:
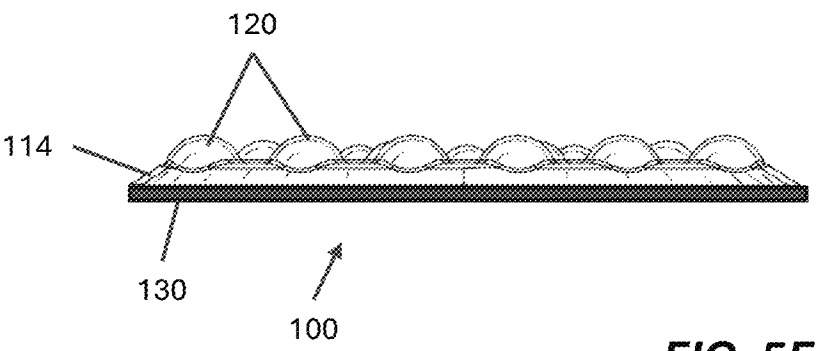
FIG. 5F shows a profile view of a lateral (outer) edge of the cuboid insert.
Figure 5E:
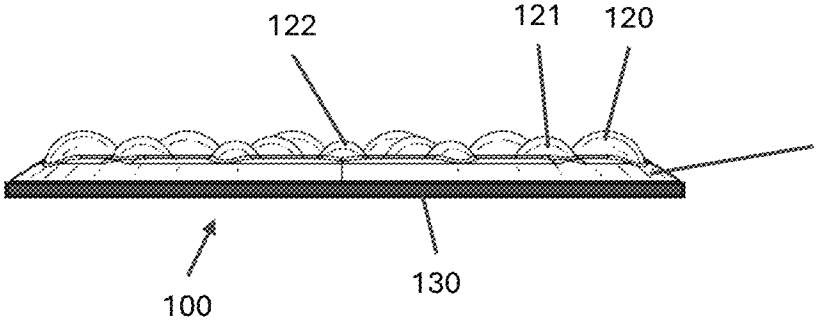
FIG. 5E shows a profile view of a medial (inner) edge of the cuboid insert.
Figure 5H:
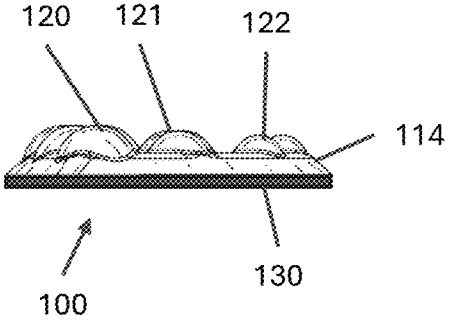
FIG. 5H shows a profile view of the cuboid insert from the other apex corner of the cuboid insert.
Figure 5G:
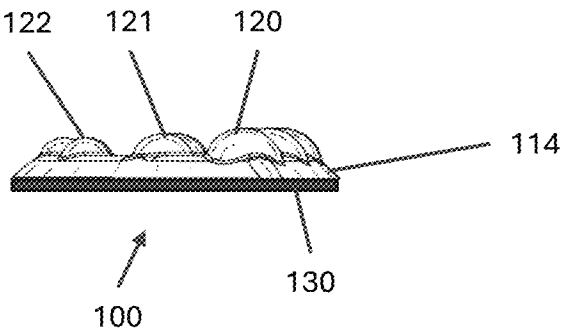
FIG. 5G shows a profile view of the cuboid insert from one apex corner (intersection of the medial and lateral edges) of the cuboid insert.

The domes 120-122 may be roughly hemispherical, as shown in FIGS. 5A and 5C-5H, but other shapes are also possible, including, for example, oblate hemispheroids, prolate hemispheroids, paraboloids, hemi-ellipsoids, and portions (e.g., halves) of convex polyhedrons. The smallest domes 122 may have radii of about 2.94 mm to about 3.78 mm (e.g., 3.36 mm), the medium domes 121 may have radii of about 3.78 mm to about 4.725 mm (e.g., 4.20 mm), and the largest domes 122 may have radii of greater than about 4.725 mm (e.g., 5 mm or 5.25 mm). The domes 120-121 in each arcuate row may be spaced apart evenly, as shown in FIGS. 5A and 5B, or unevenly. The spaces between adjacent domes are generally selected to increase or maximize the stimulation that the domes 120-122 apply to the cutaneous receptors on the bottom of the foot.

The cuboid insert 100 can be made of injection-molded or stamped elastomeric material, such as polyurethane (PU) or ethylene vinyl acetate (EVA). The elastomeric material should be firm, flexible, and resilient, e.g., with a Shore A hardness of about 40 to about 60 (e.g., 45, 50, or 55). In other words, the elastomeric material should be hard enough to stimulate the cutaneous receptors but not so hard as to be uncomfortable. If desired, the hardness can be tailored to the person wearing the cuboid insert 100. The domes 120-122 can be integral with the elastomeric base or pad-that is, the domes 120-122 and pad can be formed of a single piece of material—or can be formed of separate pieces of material or a separate layer adhered or otherwise affixed to the pad.

Figure 6:
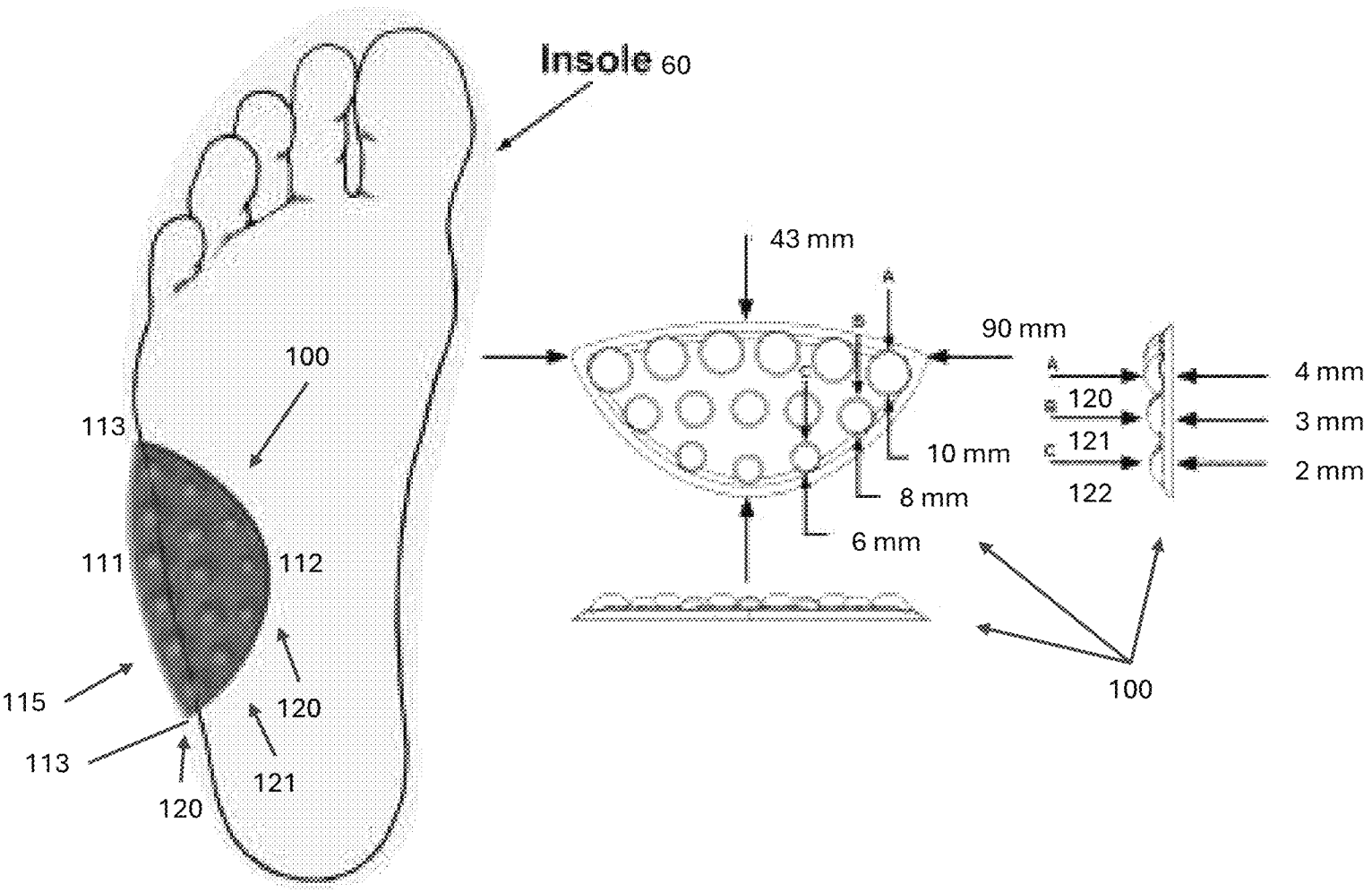
FIG. 6 shows a cuboid insert positioned on top of an insole with the outer (lateral) edge handing (extending) slightly off the outer (lateral) edge of the insole.

FIG. 6 shows the cuboid insert 100 applied to an insole 60, e.g., by sticking the adhesive layer 130 on the bottom 102 of the cuboid insert 100 to the top surface of the insole. In this example, the cuboid insert 100 is about 90 mm long (from apex corner 113 to apex corner 113) and about 43 mm wide at its widest point (from lateral edge 111 to medial edge 112). The largest domes 120 are about 4 mm high (measure from the bottom of the cuboid insert 100) and 10 mm in diameter, the medium domes 121 are about 3 mm high and 8 mm in diameter, and the smallest domes 122 are about 2 mm high and 6 mm in diameter. The apex corners 113 are positioned so they align with the outer edge of the insole 60 (points A and B in FIG. 6) and a portion 115 of the cuboid insert 100, including portions of the larger domes 120, extends slightly off the side of the insole 60 as shown in FIG. 6. In other words, the apex corners 113 are generally in line with the lateral edge of the foot, the lateral row of domes 120 is on the periphery of the lateral portion of the foot, and the middle and medial rows of domes 121, 122 are positioned under the midfoot.

When the cuboid insert 100 is positioned correctly on the insole 60, the cuboid insert 100 shown in FIG. 6 acts as a wedge that lifts up the cuboid, lifting the lateral portion higher relative to the medial portion, shifting the center of pressure to a safer midline position and creating a locking mechanism that stabilizes the foot. The lateral row of domes 120 does not stimulate the cutaneous receptors while a person wearing the cuboid insert 100 is walking with a slightly wider base of gait, whereas the middle and medial rows of domes 121, 122 provide constant stimuli to the cutaneous receptors regarding the location of the center of pressure. As the person is walking or running and starts to (accidentally) shift his or her weight too far to the side, the lateral portion of the sole of the foot will press on the lateral row of domes 120, thereby increasing pressure on the appropriate cutaneous receptors. These stimuli may induce a favorable muscle response that prevents the person from leaning too far to the side and falling. Put differently, when positioned at least partially off the side of the insole 60 as in FIG. 6, the larger domes 120 should stimulate pressure receptors in the skin only when the person wearing the cuboid insert 100 and insoles 60 shifts his or her weight too far to the outside (laterally). Most falls occur as the result of lateral weight shifts, and this stimulation triggers a muscular response that prevents the person from falling due to a lateral weight shift.

An easy way to determine if you might benefit from using cuboid inserts is to get into a safe location and stand on one foot with your eyes open and try to balance for a full 10 seconds. If you cannot balance on one foot with your eyes open for at least 10 seconds, then you should benefit from using cuboid inserts. Using cuboid inserts improves balance, which leads to better health and longer life. In a 12-year study of more than 1,700 older adults, the ability to successfully balance on one foot with eyes open was strongly correlated with longevity. In fact, individuals who were unable to balance for 10 seconds after 3 tries had an 84% higher risk of all-cause mortality, even when adjusting for other risk factors, such as heart disease, hypertension, and obesity. This study emphasizes the disastrous consequences associated with impaired balance. It also shows that it is imperative that people have their balance evaluated regularly, just like they have their cholesterol, blood pressure, and eyes examined annually. If impairment is found, preventive measures should be initiated as soon as possible, and inexpensive cuboid inserts coupled with a few simple home exercises can make a tremendous difference.

While some people find cuboid inserts 100 uncomfortable for the first few days, most people are able to tolerate them right away, often noticing a slight improvement in balance almost immediately. Cuboid inserts 100 work well when used in conjunction with a program of strengthening toes, feet, legs, and ankles for maintaining/improving balance. The cuboid inserts 100, like all textured insoles, only work while they are being worn there is an almost immediate return to baseline poor balance when discontinued. As a result, it is extremely important to strengthen feet and legs, especially toes, as foot strength plays a huge role in fall prevention. Every 1% increase in toe strength decreases a senior citizen's risk of falling by 7%.

CONCLUSION

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A cuboid lift comprising: an elastomeric pad having a first side and a second side opposite the first side and sized and shaped to fit on an insole of a shoe or footbed of a sandal with a portion of the elastomeric pad extending past a lateral edge of the insole of the shoe or footbed of the sandal; first domes disposed along a lateral edge of the first side of the elastomeric pad, each of the first domes having a first height and being positioned at least partially on the portion of the elastomeric pad extending past the lateral edge of the insole or footbed; and second domes disposed on the first side of the elastomeric pad medial to the first domes, each of the second domes having a second height smaller than the first height.

2. The cuboid lift of claim 1, wherein the elastomeric pad is sized and shaped to fold at a lateral edge of the insole such that respective portions of the first domes are positioned to apply pressure to a lateral side of a foot of a person wearing the shoe or sandal in response to excessive lateral displacement of a center of pressure of the person wearing the shoe or sandal.

3. The cuboid lift of claim 1, wherein the elastomeric pad has a thickness of about 2 mm to about 4 mm.

4. The cuboid lift of claim 1, wherein the elastomeric pad, first domes, and second domes are formed from a single piece of elastomeric material.

5. The cuboid lift of claim 4, wherein the elastomeric material comprises at least one of polyurethane or ethylene vinyl acetate.

6. The cuboid lift of claim 4, wherein the elastomeric material has a Shore A hardness of about 40 to about 60.

7. The cuboid lift of claim 4, wherein the elastomeric material has a Shore A hardness of about 45.

8. The cuboid lift of claim 1, wherein adjacent ones of the second domes are spaced apart from each other by about 12 mm to about 16 mm.

9. The cuboid lift of claim 1, further comprising:

third domes disposed on the first side of the elastomeric pad between the first domes and the second domes, each of the third domes having a third height greater than the second height and smaller than the first height.

10. The cuboid lift of claim 9, wherein the first height is about 4 mm to about 5 mm, the second height is about 2 mm to about 3 mm, and the third height is about 3 mm to about 4 mm.

11. The cuboid lift of claim 9, wherein the first domes have diameters of about 9 mm to about 12 mm, the second domes have diameters of about 5 mm to about 7 mm, and the third domes have diameters of about 7 mm to about 9 mm.

12. The cuboid lift of claim 1, further comprising:

a pressure-sensitive adhesive, disposed on the second side of the elastomeric pad, to adhere the cuboid lift to the insole of the shoe or footbed of the sandal.

13. A cuboid lift comprising:

an elastomeric pad, having a first side and a second side opposite the first side, to fit on an insole of a shoe or footbed of a sandal and shaped such that a lateral edge of the elastomeric pad extends beyond a lateral edge of the insole or footbed when fit on the insole or footbed;

first domes, disposed along the lateral edge of the first side of the elastomeric pad, to stimulate a lateral side of a midfoot of a person wearing the shoe or sandal; and second domes, disposed on the first side of the elastomeric pad medial to the first domes, to stimulate a lateral aspect of a plantar portion of the midfoot of the person wearing the shoe or sandal.

14. The cuboid lift of claim 13, further comprising:

a pressure-sensitive adhesive, disposed on the second side of the elastomeric pad, to adhere the elastomeric pad to the insole of the shoe or footbed of the sandal.

15. A balance-enhancing textured insert for an insole of a shoe or footbed of a sandal, the balance-enhancing textured insert comprising:

a base having two curved outer edges joined at each of two apex corners, the two curved outer edges and the two apex corners defining a perimeter of the base, a lateral portion of the base extending beyond a lateral edge of the insole or footbed when the balance-enhancing textured insert is disposed on the insole or footbed; and curved nodules extending from an upper surface of the base and configured to stimulate cutaneous receptors on a sole and a lateral side of a foot of a person wearing the shoe or sandal so as to prompt a reflexive muscle response to a lateral shift in a center of pressure of the person, the reflexive muscle response preventing the person from falling.

16. The balance-enhancing textured insert of claim 15, wherein the base and curved nodules are formed from a single piece of elastomeric material having a Shore A hardness of about 40 to about 60.

17. The balance-enhancing textured insert of claim 15, wherein the curved nodules are arranged in arcuate rows on the upper surface of the base.

18. The balance-enhancing textured insert of claim 15, wherein the curved nodules progressively increase in height from a medial side of the base to a lateral side of the base.

19. The balance-enhancing textured insert of claim 15, wherein the curved nodules progressively increase in diameter from a medial side of the base to a lateral side of the base.

20. The balance-enhancing textured insert of claim 15, wherein respective portions of at least some of the curved nodules are disposed on the lateral portion of the base.

* * * * *